US006227615B1

(12) United States Patent
Newhouse et al.

(10) Patent No.: US 6,227,615 B1
(45) **Date of Patent: *May 8, 2001**

(54) CHAIR HAVING AN OPERATIONAL GUIDE

(75) Inventors: Thomas J. Newhouse, Grand Rapids; Marc A. Gierz, Hudsonville; Richard C. Weise, Coopersville, all of MI (US)

(73) Assignee: Herman Miller, Inc., Zeeland, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/383,521

(22) Filed: Aug. 17, 1999

Related U.S. Application Data

(63) Continuation of application No. 08/916,970, filed on Aug. 19, 1997, now Pat. No. 5,997,080, which is a continuation of application No. 08/650,970, filed on May 21, 1996, now Pat. No. 5,700,051, which is a continuation of application No. 08/259,035, filed on Jun. 13, 1994, now abandoned.

(51) Int. Cl.[7] ..... A47C 7/62

(52) U.S. Cl. ..... 297/188.11; 297/188.08; 297/217.1; 297/463.2; 40/320; 40/649

(58) Field of Search ..... 297/188.08, 188.11, 297/188.12, 217.1, 463.1, 463.2; 40/320, 490, 491, 649

(56) References Cited

U.S. PATENT DOCUMENTS

| | | | |
|---|---|---|---|
| 2,064,749 | 12/1936 | Huber | 40/491 |
| 2,131,586 | 9/1938 | Dano | 40/320 |
| 2,545,262 | 3/1951 | Coleman | 40/649 |
| 3,991,495 | 11/1976 | Wilson | 40/375 |
| 4,715,652 | 12/1987 | Ward | 297/188.11 |

FOREIGN PATENT DOCUMENTS 154972 8/1932 (CH) .

OTHER PUBLICATIONS

HÅG Credo Collection Brochure, (date unknown).
HÅG Signét Collection Brochure, (date unknown).
The HÅG Digest, Jun. 1993.
IBM Series III Model 50 Key Operator Instructions, p. 4 (date unknown).
Copier Specs, p. 77 (date unknown).
Canon Model NP 7550 Copier.

*Primary Examiner*—Peter R. Brown
(74) *Attorney, Agent, or Firm*—Brinks Hofer Gilson & Lione

(57) ABSTRACT

An operational guide mounted to an adjustable chair as well as a chair including an operational guide. The operational guide includes a card having a pictorial guide for operating the adjustable chair located on the top side of the card. The operational guide also includes a device for mounting the card to the bottom of the seat of the chair. The mounting device is adapted to allow the card to move between an extended position wherein the pictorial guide is visible to an occupant of the chair and a retracted position wherein the pictorial guide is not visible to the occupant of the chair. Also, the mounting device holds the card so that the orientation of the pictorial guide corresponds to the orientation of the controls for adjusting the chair when the card is in the extended position.

48 Claims, 4 Drawing Sheets

CHAIR HAVING AN OPERATIONAL GUIDE

This application is a continuation of U.S. application Ser. No. 08/916,970, filed Aug. 19, 1997, now U.S. Pat. No. 5,997,080, which is a continuation of U.S. application Ser. No. 08/650,970, filed May 21, 1996, now U.S. Pat. No. 5,700,051, which is a continuation of U.S. application Ser. No. 08/259,035, abandoned filed Jun. 13, 1994, which applications are hereby incorporated by reference.

BACKGROUND OF THE INVENTION

The present invention relates to furniture. More specifically, the invention relates to an operational guide for use with an adjustable chair.

Currently, many chairs used in an office setting are adjustable in one or more ways. Because the nature of the adjustments and the mechanisms for making them vary from chair to chair, an information card with instructions for the user is often provided. Typically, such information cards are loosely fastened to the chair with a string or the like. Unfortunately, such loosely fastened information cards are unsightly and easily removable. Thus, these cards are often removed from the chair during installation so the actual chair user never sees the information card.

Another problem with some chair information cards is that they are not easily understood. In particular, since the adjustment mechanisms are often located on the bottom of the seat where they cannot be seen by the user sitting in the chair, it can be difficult for the user to understand the instructions for making adjustments.

For the foregoing reasons, there is a need for a chair having an information card that is attached to the chair in such a way so as to better insure that the chair user will have access to it, and that the instructions on the card will be easier to understand. Moreover, even if the original chair user sees the instruction card, office chairs are frequently moved from one work station to another. Subsequent chair users are even less likely to see the information card.

SUMMARY OF THE INVENTION

The invention is an operational guide mounted to an adjustable chair as well as a chair including an operational guide. The operational guide includes a card having a pictorial guide for operating the adjustable chair located on the top side of the card. The operational guide also includes a device for mounting the card to the bottom of the seat of the chair. The mounting device is adapted to allow the card to move between an extended position wherein the pictorial guide is visible to an occupant of the chair and a retracted position wherein the pictorial guide is not visible to the occupant of the chair. Also, the mounting device holds the card so that the orientation of the pictorial guide corresponds to the orientation of the controls for adjusting the chair when the card is in the extended position.

An advantage of the preferred embodiment is that a user, while seated in the chair, may conveniently move the information card into the extended position to view the chair operating information. When the card is in the extended position, the orientation of the pictorial guide on the top of the card corresponds to the orientation of the controls for adjusting the chair, thus providing easier to understand instruction.

Another advantage of the preferred embodiment is that an information card holder is mounted to the chair so that the holder may not be easily removed from the chair. Moreover, the preferred embodiment avoids use of unsightly tags or the like dangling from the chair.

BRIEF DESCRIPTION OF THE DRAWING

These and other features, aspects, and advantages of the present invention will become better understood with regard to the following description, appended claims, and accompanying drawings where:

DETAILED DESCRIPTION OF THE PREFERRED EMBODIMENT

Figure 1:
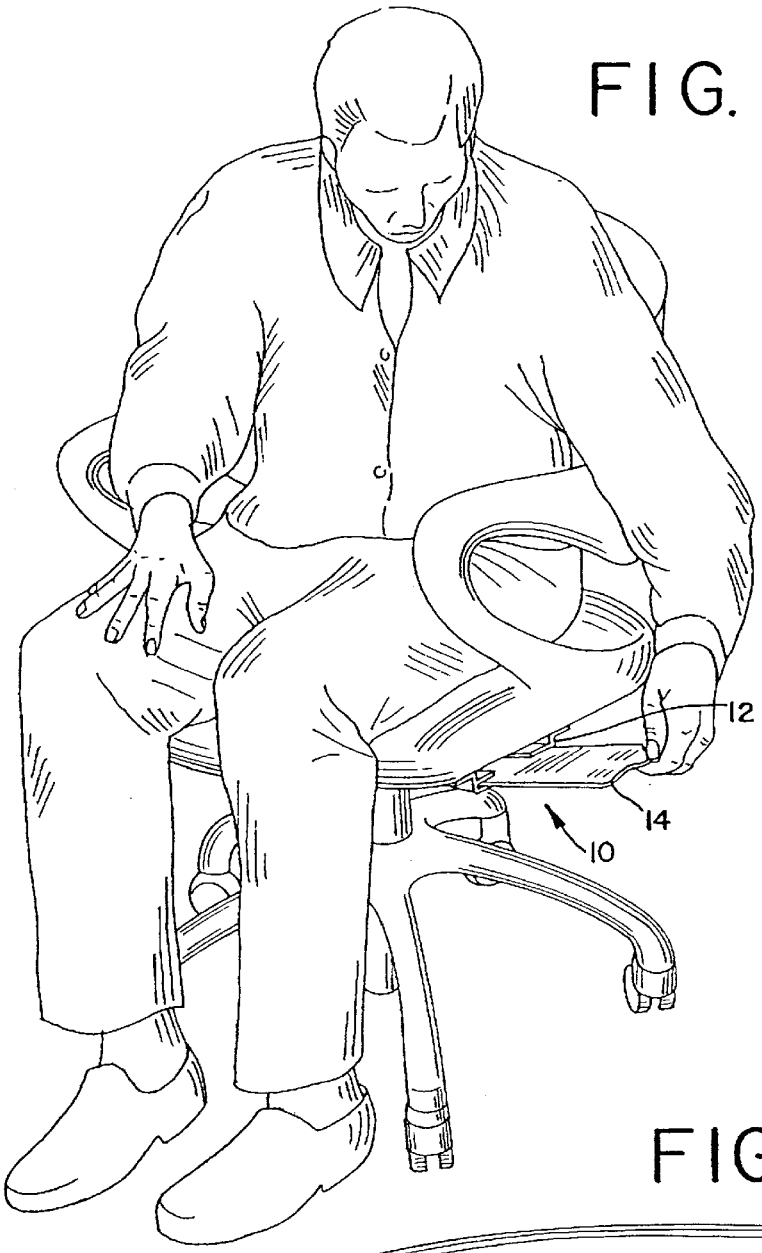
FIG. 1 shows a man using a preferred embodiment of the invention.

FIG. 1 shows a chair 10, a holder 12 mounted to the chair 10, and an information card 14 that slides into the holder 12. The information card holder 12 is positioned under the seat of the chair to properly orient the information card 14, thereby allowing improved user instruction. The information card 14 for informing a chair's user of proper operating methods is mounted to the chair 10 so that the information card 14 can not be easily removed from the chair 10. (See also FIG. 5) The information card 14 is preferably made of a heavy plastic material, such as polypropylene.

Figure 2:
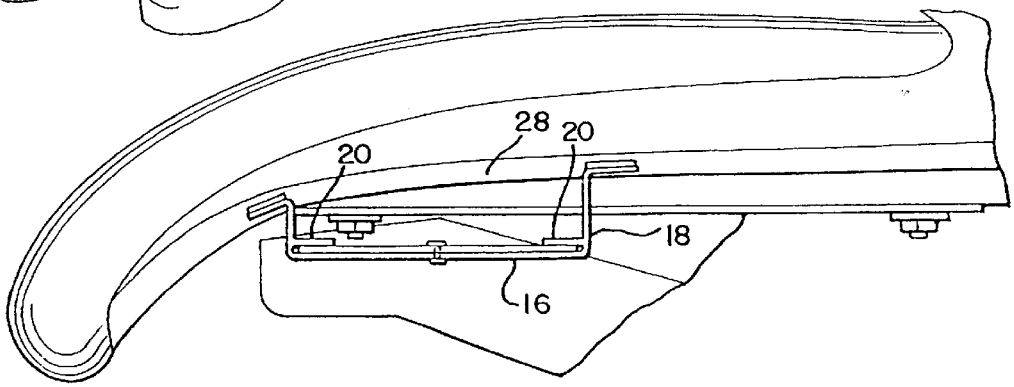
FIG. 2 shows a side view of the seat of the chair of FIG. 1 disclosing a more detailed view of the information card holder.

FIG. 2 shows that the holder 12 contains a bottom plate 16 and side walls 18 connected to the bottom plate. Preferably, the bottom plate 16 is positioned a minimum of 0.6" below the seat 28 of the chair 10 at one end of the holder 12 and a maximum of 1.1" below the seat 28 of the chair 10 at the other end of the holder 12. Additionally, the seat 28 preferably forms a minimum angle of 70 degrees with one of the side walls 18 proximate one end of the holder 12 and a maximum angle of 90 degrees with the other side wall 18 proximate the other end of the holder 12.

A pair of flanges 20 spaced apart from the bottom plate 16 extend inwardly from the side walls 18 of the holder 12. Preferably, each flange 20 forms a 90 degree angle with its corresponding side wall 18. The flanges 20 function as a guide member for guiding the information card 14 within the holder 12 in a travel path parallel to the holder 12.

Figure 3:
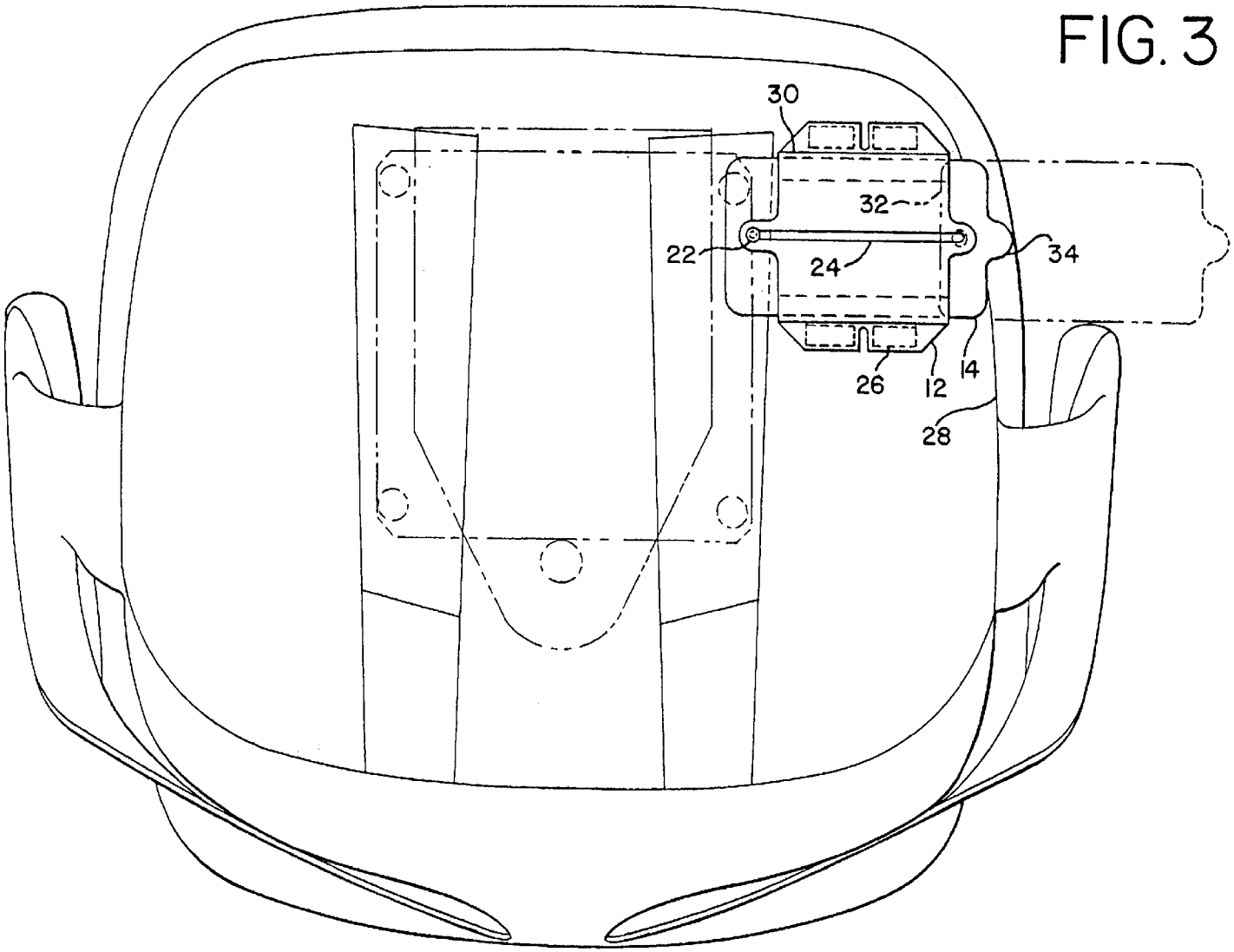
FIG. 3 shows a bottom view of the seat of the chair of FIG. 1.
Figure 3A:
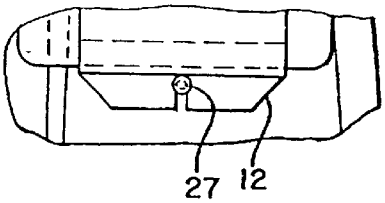
FIG. 3A shows an alternative embodiment of the invention where the holder is mounted to the chair with fasteners.
Figure 3B:
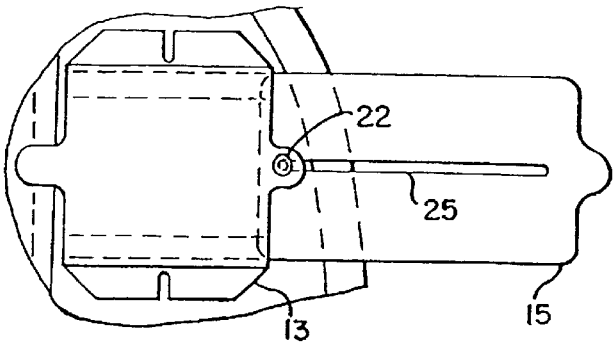
FIG. 3B shows an alternative embodiment of the invention where a longitudinal slot is positioned in the card.

FIG. 3 shows a travel limiting member 22, which as shown is preferably a rivet, connecting the holder 12 and the card 14. The travel limiting member 22 extends through a longitudinal slot 24 formed in the middle of the holder 12 mounting the information card 14 to the holder 12. Alternatively, as shown in FIG. 3B, the travel limiting member 22 can extend through a longitudinal slot 25 formed in the information card so as to mount the information card 15 to the holder 13. Preferably, the combination of the travel limiting member 22 and the longitudinal slot 24 should limit the travel of the information card 14 to a travel length of about 4.75".

Two-sided tape 26 is used to mount the holder 12 to the seat 28 of the chair 10. The two-sided tape 26 preferably is made of foam material and forms a rectangular shape having dimensions of 0.5" by 1". Alternatively, the holder 12 can be mounted to the seat 28 of the chair 10 with fasteners 27 as shown in FIG. 3A.

FIG. 3 shows a card 14 having a length 30 greater than its width 32. Preferably, the information card 14 has a length 30 of 6.25" and a width 32 of 4.75".

The information card 14 contains a tab 34 at one end. The tab 34 extends from the holder 12 even when a majority of the card 14 is inside the holder 12. The tab 34 allows a user to easily slide the information card 14 out from under the chair seat 28. Preferably the tab 34 forms a substantially semicircular shape having a radius of 0.6–0.7".

Figure 4:
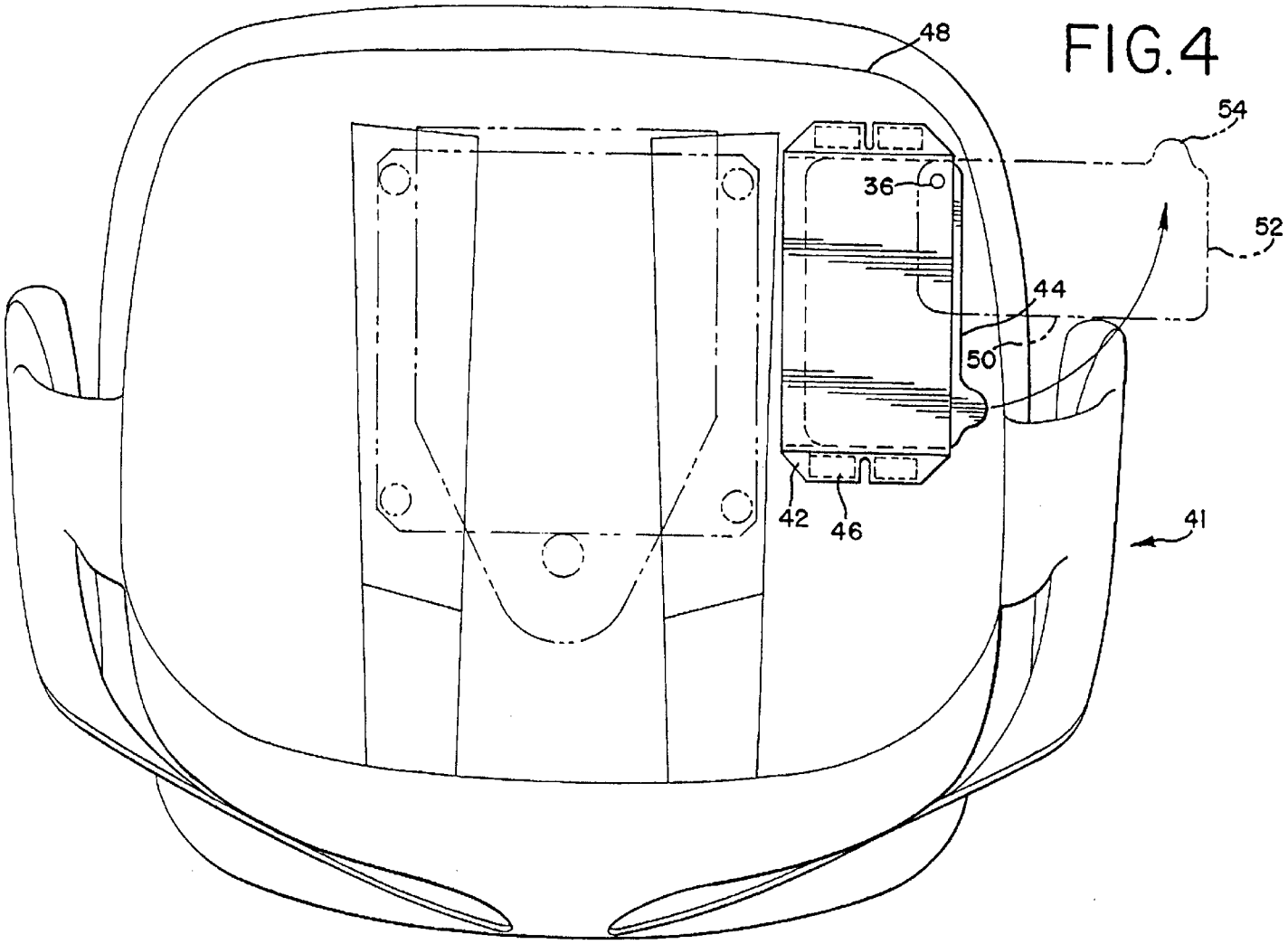
FIG. 4 shows an alternative embodiment of the invention where the information card is mounted to the chair using a pivot.

A user may grip the tab 34 and slide the information card 14 from a retracted position wherein at least a major portion of the top side of the card 14 is not visible to the occupant of the chair to an extended position wherein at least a major portion of the top side of the card 14 is visible to an occupant of the chair 10. A pictorial guide 38 for operating the chair is located on the top side of the card 14. Moreover, the invention is adapted to hold the card 14 so that the orientation of the pictorial guide 38 corresponds to the orientation of the means for adjusting the chair 10 when the card 14 is in the extended positions FIG. 4 shows a second preferred embodiment of the invention. FIG. 4 shows a pivot point 36, such as a rivet, pivotally mounting a card 44 to a mounting means such as a holder 42. The information card 44 is preferably made of a heavy plastic material, such as polypropylene.

The pivot point 36 is positioned in combination with the card 44 and the holder 42 to allow the card 44 to rotate about a generally horizontal plane between an extended position wherein the pictorial guide 38 is visible to an occupant of a chair 41 and a retracted position wherein the pictorial guide 38 is not visible to the occupant of the chair. Moreover, the pivot point 36 is adapted to hold the card 44 so that the orientation of the pictorial guide 38 corresponds to the orientation of the means for adjusting the chair 41 when the card 44 is in the extended position.

Two-sided tape 46 is used to mount the holder 42 to the seat 48 of the chair 41. The two-sided tape 46 preferably is made of foam material and forms a rectangular shape having dimensions of 0.5" by 1".

FIG. 4 shows a holder 42 having a length 50 greater than its width 52. Preferably, the information card has a length 50 of 6.25" and a width 52 of 4.75".

The information card 44 contains a tab 54 at one end. The tab 54 extends from the holder 42 even when a majority of the card 44 is inside the holder 42. The tab 54 allows a user to easily slide the information card 44 out from under the chair seat 48. Preferably the tab 54 forms a substantially semicircular shape having a radius of 0.6–0.7".

Figure 5B:
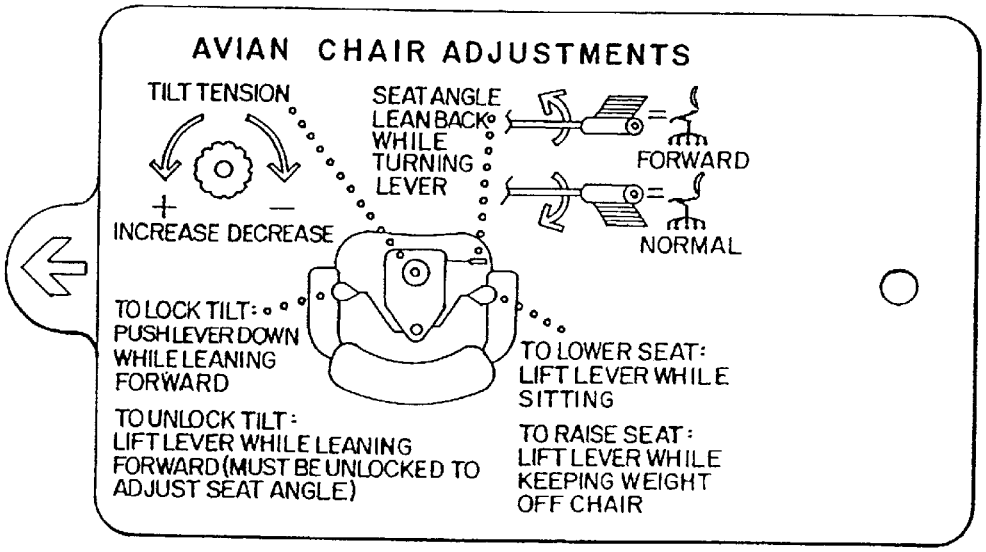
FIG. 5B shows an alternative pictorial guide.
Figure 5A:
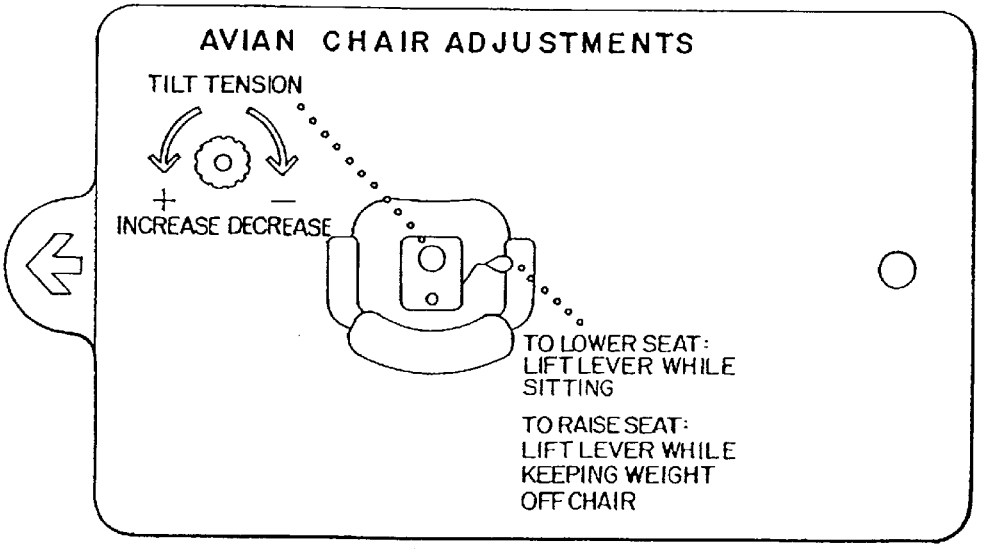
FIG. 5A shows an exemplary pictorial guide.

FIG. 5 shows an example of a pictorial guide 38 located on the top side of the information card 14. When the information card 14 is in the extended position, the pictorial guide is oriented so that the adjustment instructions 40 depicted in the pictorial guide 38 correspond to the orientation of the actual method for adjusting the chair 10. In other words, the adjustment features on the right side of the chair are shown on the right side of the card and vice versa.

The foregoing detailed description should be regarded as illustrative rather than limiting and the appended claims including all equivalents are intended to define the scope of the invention.

What is claimed is:

1. A chair comprising:

a seat;

at least one adjustment control allowing a user to adjust the chair;

an operational guide having instructional indicia instructive about the operation of the at least one adjustment control, said operational guide moveably mounted to the seat, said operational guide moveable between a retracted position and an extended position;

a track formed on said seat, and said operational guide having a protuberance moving within said track as said operational guide moves between said retracted position and said extended position.

2. The chair of claim 1 wherein said seat comprises a holding portion defining said track.

3. The chair of claim 2 wherein said track is formed as a slot in said holding portion, and wherein said seat further comprises a seating portion, wherein said holding portion is connected to a bottom of said seating portion.

4. The chair of claim 2 wherein said holding portion defines an opening, wherein said operational guide is moveable through said opening between said retracted position and said extended position.

5. The chair of claim 4 wherein said opening opens outwardly from a side portion of said seat, wherein said operational guide is visible along a side portion of the seat when moved to the extended position.

6. The chair of claim 1 wherein said protuberance comprises a rivet extending from one of said operational guide and said seat.

7. A chair comprising:

a seat;

at least one adjustment control allowing a user to adjust the chair;

an operational guide having instructional indicia instructive about the operation of the at least one adjustment control, said operational guide moveably mounted to the seat, said operational guide moveable between a retracted position and an extended position;

a track formed on one of said operational guide and said seat, and the other of said operational guide and said seat having at least a portion moving within said track as said operational guide moves between said retracted position and said extended position, wherein said at least said portion comprises a travel limiting member engaging an end of said track when said operational guide is moved to the extended position whereby said operational guide is prevented from being separated from said seat.

8. The chair of claim 7 wherein said track is formed on said seat and wherein said operational guide comprises said at least said portion moving within said track.

9. The chair of claim 8 wherein said seat comprises a holder defining said track.

10. The chair of claim 9 wherein said track is formed as a slot in said holder.

11. The chair of claim 9 wherein said holder defines an opening, wherein said operational guide is moveable through said opening between said retracted position and said extended position.

12. The chair of claim 11 wherein said opening opens outwardly from a side portion of said seat, wherein said operational guide is visible along a side portion of the seat when moved to the extended position.

13. The chair of claim 7 wherein said at least said portion comprises a travel limiting member engaging an end of said track when said operational guide is moved to the extended position whereby said operational guide is prevented from being separated from said seat.

14. The chair of claim 7 wherein said at least said portion comprises a protuberance.

15. The chair of claim 14 wherein said protuberance comprises a rivet extending from one of said operational guide and said seat.

16. The chair of claim 7 wherein said track is formed on said operational guide and wherein said seat comprises said at least said portion moving within said track.

17. A chair comprising:

a seat;

at least one adjustment control allowing a user to adjust the chair;

an operational guide having instructional indicia instructive about the operation of the at least one adjustment control, said operational guide moveably mounted to the seat, said operational guide moveable between a retracted position and an extended position;

a track formed on said operational guide and wherein said seat comprises at least a portion moving within said track as said operational guide moves between said retracted position and said extended position.

18. The chair of claim 17 wherein said track is formed as a slot in said operational guide.

19. The chair of claim 18 wherein said at least said portion comprises a rivet moving within said slot.

20. A chair comprising:

a seat comprising a pair of parallel, spaced apart guides;

at least one adjustment control allowing a user to adjust the chair;

an operational guide comprising opposite side portions moveably received in said guides and instructional indicia instructive about the operation of the at least one adjustment control, said operational guide moveable between a retracted position and an extended position, said operational guide engaging said seat when said operational guide is in the extended position.

21. The chair of claim 20 wherein said seat further comprises a holding portion defining said pair of guides and further comprising a travel limiting member disposed on one of said holding portion and said operational guide, said travel limiting member engaging the other of said holding portion and said operational guide when said operational guide is in the extended position so as to prevent separation of the operational guide from the holding portion.

22. The chair of claim 21 wherein said holding portion defines an opening, wherein said operational guide is moveable through said opening between said retracted position and said extended position.

23. The chair of claim 22 wherein said opening opens outwardly from a side portion of said seat, wherein said operational guide is visible along a side portion of the seat when moved to the extended position.

24. The chair of claim 21 wherein said seat further comprises a seating portion, and wherein said holding portion is attached to a bottom of said seating portion.

25. A chair comprising:

a seat;

at least one adjustment control allowing a user to adjust the chair;

an operational guide having a portion with indicia instructing the user about the operation of the at least one adjustment control, said operational guide moveably mounted to the seat, said operational guide moveable between a retracted position where the indicia is not visible to the user when sitting in the chair and an extended position wherein said portion with said indicia is capable of being positioned in a substantially horizontal orientation such that the indicia is visible to the user when sitting in the chair, wherein said seat guides the operational guide such that the indicia is maintained in the same orientation relative to the user each time said portion with said indicia is positioned in the substantially horizontal orientation when said operational guide is in the extended position; and a travel limiting member extending from one of said seat and said operational guide, said travel limiting member engaging the other of said seat and said operational guide when said operational guide is in an extended position so as to prevent the operational guide from being separated from the seat.

26. The chair of claim 25 wherein said travel limiting member extends from said operational guide and engages said seat.

27. The chair of claim 25 wherein said seat further comprises a holding portion, wherein said operational guide is moveably mounted to said holding portion, and wherein said travel limiting member extends from one of said holding portion and said operational guide and engages the other of said holding portion and said operational guide.

28. The chair of claim 22 wherein said holding portion comprises a guide, wherein said operational guide is slideably mounted in said holding portion guide.

29. The chair of claim 27 wherein said seat further comprises a seating portion, and wherein said holding portion is attached to a bottom of said seating portion.

30. A chair comprising:

a seat comprising a holding potion, wherein said holding portion comprises a pair of parallel, spaced apart guides;

at least one adjustment control allowing a user to adjust the chair;

an operational guide having a portion with indicia instructing the user about the operation of the at least one adjustment control, said operational guide slidably mounted in said holding portion guides, said operational guide moveable between a retracted position where the indicia is not visible to the user when sitting in the chair and an extended position wherein said portion with said indicia is capable of being positioned in a substantially horizontal orientation such that the indicia is visible to the user when sitting in the chair, wherein the indicia is maintained in the same orientation relative to the user each time said portion with said indicia is positioned in the substantially horizontal orientation when said operational guide is in said extended position; and a travel limiting member extending from one of said holding portion and said operational guide, said travel limiting member engaging the other of said holding portion and said operational guide when said operational guide is in said extended position so as to prevent the operational guide from being separated from the holding portion.

31. The chair of claim 30 wherein said operational guide comprises opposite edge portions that slide in said holding portion guides.

32. A method for adjusting the position of a chair while occupied by a user, said method comprising:

providing a chair comprising a seat and at least one adjustment control;

providing an operational guide moveably attached to said seat, said operational guide comprising a portion having instructional indicia about the operation of said at least one adjustment control;

providing a travel limiting member extending from one of said seat and said operational guide;

successively moving said operational guide between a retracted position and an extended position, wherein said travel limiting member engages the other of said seat and said operational guide when said operational guide is moved to the extended position;

positioning said portion with said indicia in an substantially horizontal orientation when said operational guide is in the extended position, wherein said seat guides said operational guide such that said indicia is oriented in the same way relative to the user each time said portion with said indicia is positioned in said substantially horizontal orientation when said operational guide is in the extended position; and instructing the user about how to the operate the at least one adjustment control with said indicia when said portion with said indicia is positioned in said horizontal orientation when said operational guide is in the extended position.

33. The chair of claim 32 wherein said travel limiting member extends from said operational guide and engages said seat.

34. The chair of claim 32 wherein said seat further comprises a holding portion, wherein said operational guide is moveably mounted to said holding portion.

35. The chair of claim 34 wherein said holding portion comprises a guide, wherein said operational guide is slideably mounted in said holding portion guide.

36. The chair of claim 35 wherein said holding portion defines an opening, wherein said operational guide is moveable through said opening between said retracted position and said extended position.

37. A method for adjusting the position of a chair while occupied by a user, said method comprising:

providing a chair comprising a seat and at least one adjustment control, wherein said seat comprises a holding portion and wherein said holding portion comprises a pair of parallel, spaced apart guides;

providing an operational guide slidably mounted in said holding portion guides, said operational guide comprising a portion having instructional indicia about the operation of said at least one adjustment control;

providing a travel limiting member extending from one of said holding portion and said operational guide;

successively moving said operational guide between a retracted position and an extended position, wherein said travel limiting member engages the other of said holding portion and said operational guide when said operational guide is moved to the extended position;

positioning said portion with said indicia in an substantially horizontal orientation when said operational guide is in the extended position, wherein said indicia is oriented in the same way relative to the user each time said portion with said indicia is positioned in said substantially horizontal orientation; and instructing the user about how to the operate the at least one adjustment control with said indicia when said portion with said indicia is positioned in said horizontal orientation.

38. The method of claim 37 wherein said operational guide comprises opposite edge portions that slide in said holding portion guides.

39. The method of claim 37 wherein said seat further comprises a seating portion, and wherein said holding portion is attached to a bottom of said seating portion.

40. A chair comprising:

a body support member comprising an upper surface adapted to support a portion of the body of a user;

at least one adjustment control allowing a user to adjust the chair;

an instructional guide comprising a surface with instructional indicia disposed thereon, said instructional indicia instructive about the operation of said at least one adjustment control, said instructional guide connected to a holder connected to an underside of said body support member so as to prevent said instructional guide from being separated from the holder by the user;

said instructional guide and said body support member moveable relative to each other between an exposed position wherein said instructional indicia is visible to the user and wherein said holder holds said instructional guide such that the orientation of said indicia corresponds to the orientation of the at least one adjustment control and a hidden position wherein said instructional indicia is not visible to the user beneath said body support member.

41. The chair of claim 40 wherein said surface of said operational guide with said indicia is an upper surface, and wherein said upper surface is disposed beneath a bottom surface of said body support member when said operational guide is in the hidden position.

42. The chair of claim 40 wherein said operational guide is connected to said holding portion with a fastener.

43. The chair of claim 40 wherein said holder is connected to said body support member with a fastener.

44. A method for adjusting a chair, the method comprising:

providing a body support member comprising a surface adapted to support a portion of the body of a user;

providing a holding member connected to an underside of said body support member;

providing at least one adjustment control;

providing an instructional guide comprising an upwardly facing surface and instructional indicia disposed on said upwardly facing surface, said instructional indicia instructive about the operation of said at least one adjustment control, said instructional guide connected to said holding member such that said instructional guide cannot be separated from said holding member by the user;

moving at least one of said body support member and said instructional guide relative to the other between an exposed position wherein said instructional indicia is visible to the user and wherein said holding member holds said instructional guide such that the orientation of said indicia corresponds to the orientation of the at least one adjustment control and a hidden position wherein said instructional indicia are positioned beneath the body support member and are not visible to the user.

45. The method of claim 44 wherein said operational guide is connected to said holding member with a fastener.

46. The method of claim 44 wherein said holding member is connected to body support member with a fastener.

47. A chair comprising:

a body support member comprising an upper surface adapted to support a portion of the body of a user;

at least one adjustment control flowing a user to adjust the chair;

an instructional guide comprising a surface with instructional indicia disposed thereon, said instructional indicia instructive about the operation of said at least one adjustment control, said instructional guide connected to a holder connected to an underside of said body support member so as to prevent said instructional guide from being separated from the holder by the user;

said instructional guide and said body support member moveable relative to each other between an exposed position wherein said instructional indicia is visible to the user and a hidden position wherein said instructional indicia is not visible to the user beneath said body support member, wherein said holder maintains said instructional guide in substantially the same orientation each time said indicia are visible to the user in said exposed position.

48. A method for adjusting a chair, the method comprising:

providing a body support member comprising a surface adapted to support a portion of the body of a user;

providing a holding member connected to an underside of said body support member;

providing at least one adjustment control;

providing an instructional guide comprising an upwardly facing surface and instructional indicia disposed on said upwardly facing surface, said instructional indicia instructive about the operation of said at least one adjustment control, said instructional guide connected to said holding member such that said instructional guide cannot be separated from said holding member by the user;

moving at least one of said body support member and said instructional guide relative to the other between an exposed position wherein said instructional indicia is visible to the user and a hidden position wherein said instructional indicia are positioned beneath the body support member and are not visible to the user, wherein said holding member maintains said instructional guide in substantially the same orientation each time said indicia are visible to the user in said exposed position.

* * * * *

UNITED STATES PATENT AND TRADEMARK OFFICE

CERTIFICATE OF CORRECTION

PATENT NO. : 6,227,615 B1
APPLICATION NO. : 09/383521
DATED : May 8, 2001
INVENTOR(S) : Thomas J. Newhouse et al.

It is certified that error appears in the above-identified patent and that said Letters Patent is hereby corrected as shown below:

In the Claims

In claim 28, line 1, delete “22” and substitute --27-- in its place.

In claim 30, line 2, delete “potion” and substitute --portion-- in its place.

In claim 32, line 24, delete “the” second occurrence.

In claim 36, line 1, delete “35” and substitute --34-- in its place.

In claim 37, line 24, delete “the” second occurrence.

In claim 47, line 4, delete “flowing” and substitute --allowing-- in its place.

Signed and Sealed this

Twenty-fifth Day of March, 2008

JON W. DUDAS
*Director of the United States Patent and Trademark Office*

UNITED STATES PATENT AND TRADEMARK OFFICE

CERTIFICATE OF CORRECTION

PATENT NO. : 6,227,615 B1
APPLICATION NO. : 09/383521
DATED : May 8, 2001
INVENTOR(S) : Thomas J. Newhouse et al.

It is certified that error appears in the above-identified patent and that said Letters Patent is hereby corrected as shown below:

In the Claims

Column 6, line 28 in claim 28, delete "22" and substitute --27-- in its place.

Column 6, line 35 in claim 30, delete "potion" and substitute --portion-- in its place.

Column 7, line 22 in claim 32, delete "the" second occurrence.

Column 7, line 36 in claim 36, delete "35" and substitute --34-- in its place.

Column 7, line 64 in claim 37, delete "the" second occurrence.

Column 9, line 4 in claim 47, delete "flowing" and substitute --allowing-- in its place.

This certificate supersedes the Certificate of Correction issued March 25, 2008.

Signed and Sealed this

Fifteenth Day of April, 2008

JON W. DUDAS
*Director of the United States Patent and Trademark Office*